United States Patent [19]

Neddermeyer et al.

[11] 4,221,168

[45] Sep. 9, 1980

[54] CONDENSER POWERED FUZE

[76] Inventors: Seth H. Neddermeyer, 9508 44th Ave., N.E., Seattle, Wash. 98115; Robert A. Becker, Physics Dept., University of Illinois, Urbana, Ill. 60612

[21] Appl. No.: 2,534

[22] Filed: Jan. 15, 1948

[51] Int. Cl.[3] ..... F42C 13/00

[52] U.S. Cl. ..... 102/211

[58] Field of Search ..... 102/70.2, 211–214

[56] References Cited

U.S. PATENT DOCUMENTS

| | | | |
|---|---|---|---|
| 1,755,023 | 4/1930 | Ruhleman | 102/209 |
| 2,403,567 | 7/1946 | Wales, Jr. | 102/207 |

*Primary Examiner*—Charles T. Jordan

*Attorney, Agent, or Firm*—Nathan Edelberg; Robert P. Gibson; Anthony T. Lane

EXEMPLARY CLAIM

1. In a proximity fuze comprising a target-responsive circuit including a first electronic grid controlled tube and a squib detonating circuit including a second electronic grid controlled tube; a B tube voltage supply for said tube circuits comprising a condenser, an external connection for charging said condenser from an external source, and circuit means for connecting said condenser to said tube circuits, said circuit means including a biasing resistor connected between the minus terminal of said condenser and the cathode of said first grid controlled tube, a second biasing resistor connected between the grid of the second grid controlled tube and the minus terminal of said condenser whereby when the B drain of the said fuze exceeds a predetermined level, the bias on said second grid controlled tube is reduced to the firing point, thereby igniting said squib.

3 Claims, 8 Drawing Figures

FREQUENCY RESPONSE

FLATNESS CHARACTERISTIC

+ CHARGING TERMINAL
1a
2a
3a
4a
5a
6a
7a
1.0 M
19
18
5M
14
SA 782B
2'
.002µf
13
2 OHMS
15
30
.001µf
10M
6
7
25 M
.005 µf
QF 206
1
MICA .0005µf
10
90 M
11
8
V
5
RCA 956
CONDENSER UNIT A
2b
3b
5b
6b
C2
24
25
20
3
18
S
4'
27
26
28
C
+1.5V
3'
C2'
1.7µf
.25 M
R1'
.5µf
C1'
B

CONDENSER POWERED FUZE

This invention relates to fuzes generally and particularly to a condenser-powered fuze.

In proximity fuzes of the radio or photoelectric types, as shown and described in co-pending applications Ser. No. 537,983, filed May 30, 1944, and Ser. No. 568,020, filed Dec. 13, 1944, By Hinman and Diamond, and Henderson et al respectively, it is necessary to provide a source of potential and current for the electronic tubes as well as for the detonator. Since space is limited in fuzes and since miniature batteries are expensive and have limited shelf life, it is desirable to employ a more satisfactory power source for the B supply and the detonator. The requirements can be met by the use of one or more condensers which can be charged to a definite potential difference just before firing the carrying projectile.

We are aware that the broad principle of charging a condenser as a source of power for an electric fuze is old in the art as exemplified by the patent to Ruhlemann, U.S. Pat. No. 1,776,796. It is an object of our invention to effect improvement in the utilization of condensers as a source of power in a fuze.

It is a particular object to provide a proximity fuze utilizing a condenser as a high-voltage or "B" supply; and in such a fuze to effect a high efficiency in instant response thereof to the presence of a target by providing a detonating voltage suitably proportioned with respect to the available "B" voltage to effect efficient operation at all times within the target-seeking interval of the fuzed projectile.

It is also an object to provide, in a proximity fuze, a novel and dependable firing system.

A further object is the provision of novel and reliable means for causing self-destruction of the fuze after a predetermined time if no previous detonation occurs by target effect or by impact.

Figure 1:
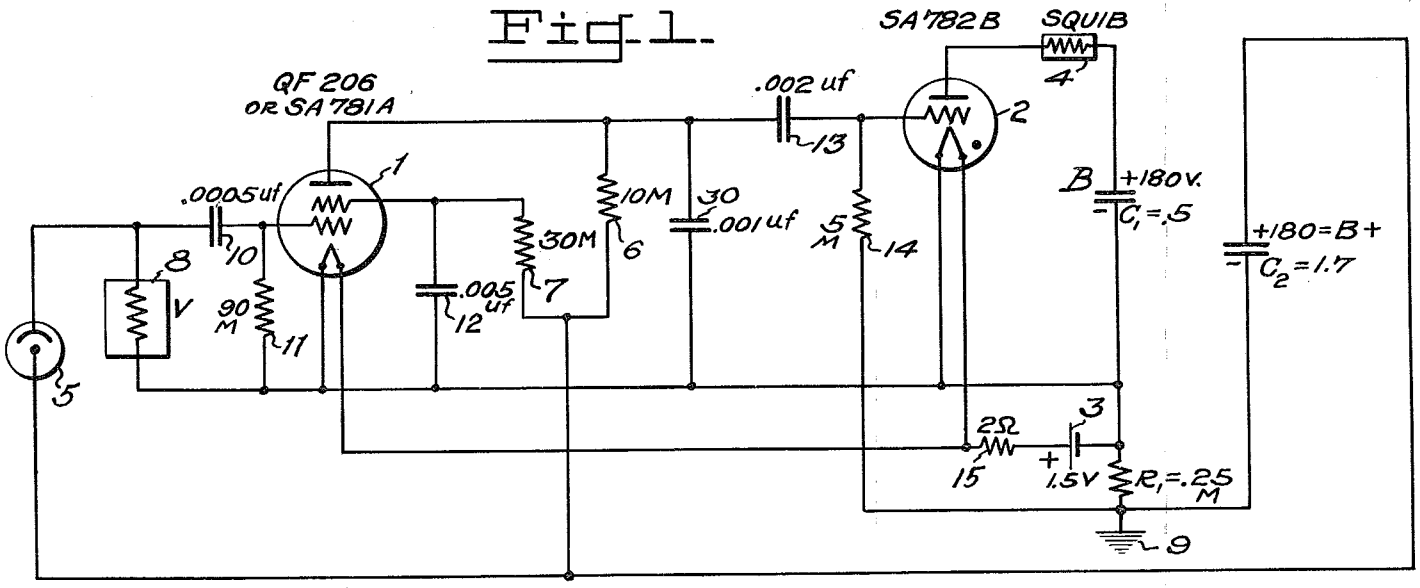
Figure 2:
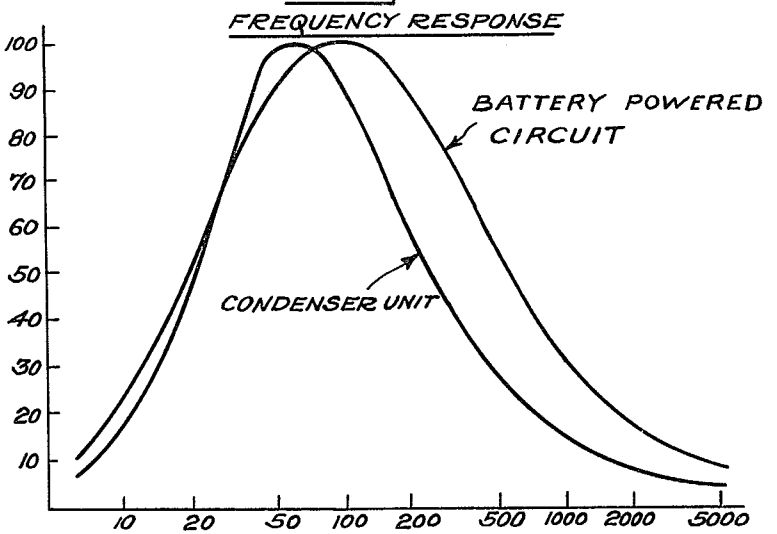
Figure 3:
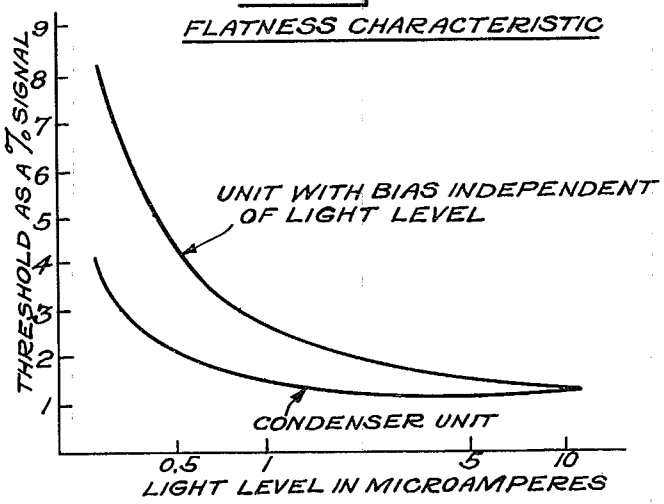
Figure 4:
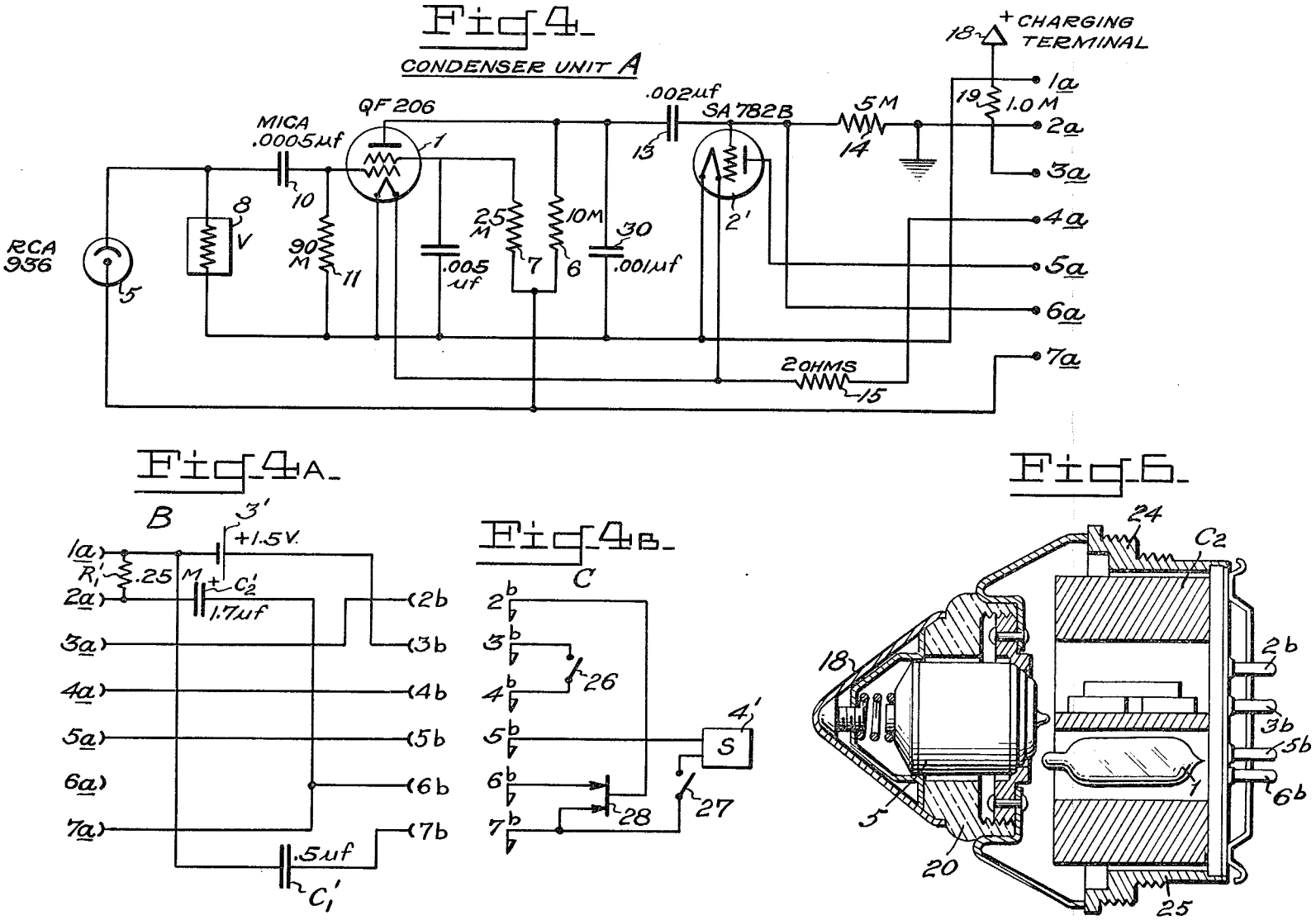
Figure 5:
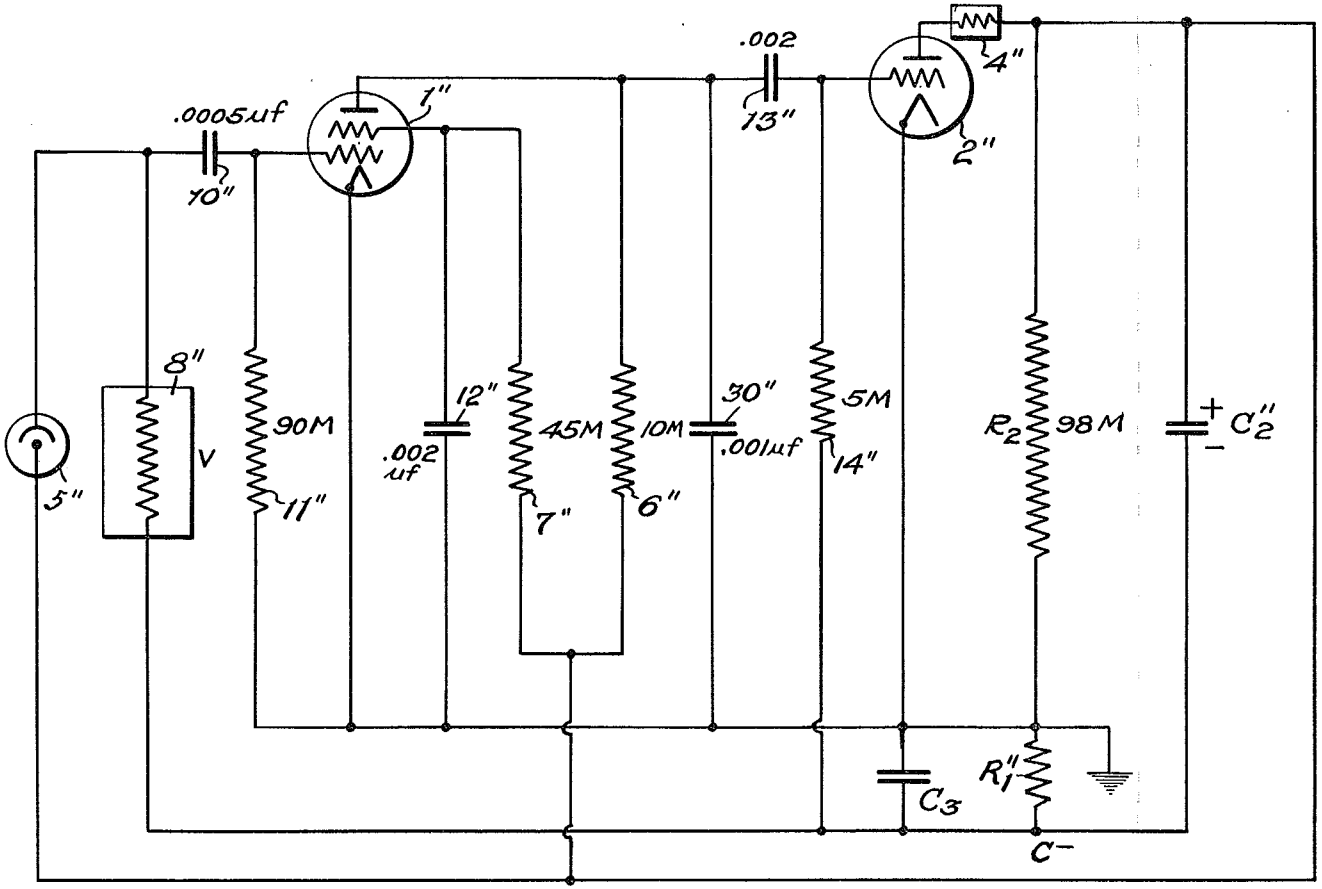

Additional objects, advantages and features of invention reside in the construction, arrangement and combination of parts or elements involved in the embodiment of the invention as will be apparent or understood from the following description and accompanying drawings, wherein:

FIG. 1 is a schematic circuit diagram of a condenser-powered photoelectric fuze, employing two chargeable condensers, FIG. 2 shows output-frequency response curves for a condenser-powered photoelectric fuze and a similar battery-powered fuze, FIG. 3 shows curves of threshold vs. light level for a condenser-powered photoelectric fuze and a battery-powered fuze, FIGS. 4, 4A and 4B, are circuit diagrams of a condenser powered fuze as actually constructed, FIG. 5 is an alternative circuit diagram of a fuze employing one power condenser, FIG. 6 is a longitudinal axial sectional view of an embodiment of a fuze constructed according to our invention, showing the physical arrangement of parts.

In FIG. 1 current for the filaments of amplifier tube 1 and thyratron 2 is supplied by "A" battery 3 which may be of relatively small size since it is required to furnish small current at 1.5 volts or less. The B power supply consists of condenser $C_2$ which may be charged to 180 volts as indicated, the positive plate of the condenser being connected directly with the anode of photocell 5, and to the anode and screen of tube 1 through resistors 6 and 7 respectively. The negative terminal of condenser $C_2$ is connected to ground 9.

Non-linear resistor 8 is connected between the cathode of photocell 5 and ground 9, through resistor $R_1$. The cathode-connected terminal of resistor 8 is also coupled to the grid of tube 1 through condenser 10 and grid leak 11, which may also be considered as a load resistance.

Screen dropping resistor 7 is shunted by condenser 12 which acts as a by-pass. Resistor 6 is a load resistance for the plate circuit of tube 1 and potential variations across this resistor are impressed on the grid of thyratron 2 through coupling condenser 13. Thyratron grid leak 14 is connected between grid and ground as shown. The grid bias of the thyratron is determined by the potential drop across resistor $R_1$ through resistor 14. It will be seen that the plate and screen currents of tube 1 as well as the current through photocell 5 all pass through resistor $R_1$. Therefore the negative bias of the thyratron grid becomes less as condenser $C_2$ loses potential, since the current flow through resistor $R_1$ is then reduced. This results in a fuze that becomes more sensitive with increasing time. When the current flows from condenser $C_2$ for a sufficient length of time, usually 10 to 12 seconds, the negative bias of the thyratron is reduced to the point where the thyratron will fire, thereby providing automatic self destruction in case the fuze is not previously fired.

The potential for the plate circuit of the thyratron is provided by condenser $C_1$ connected as shown. By using this separate thyratron condenser it is not necessary for the thyratron plate current to traverse resistor $R_1$, so that a relatively large current through squib 4 can be realized. A small filament circuit resistance 15 is provided in series with battery 3.

The operation of the circuit is essentially the same as that described in the Henderson et al application previously referred to. The sudden reduction of illumination striking the cathode of photocell 5 as the fuze passes a target produces a sudden diminution of current passing through non-linear resistor 8 so that the potential drop across this resistor, which is applied to the grid of tube 1, is suddenly reduced and consequently a pulse is transmitted to the grid through condenser 10. This pulse is amplified and is then passed on to the grid of thyratron 2, tending to drive that grid in the positive direction. If the amplitude of the pulse is sufficient the thyratron will be fired and the energy in condenser $C_1$ will be passed through squib 4 to fire the fuze.

Non-linear resistor 8 is reduced in resistance value as the current through it increases so that approximately the same percentage of change of illumination, regardless of actual light level, will produce substantially the same percentage change of current in the amplifier.

The frequency response of the condenser driven circuit of FIG. 1, as compared to that for a battery powered circuit as used in the Henderson et al fuze, is illustrated by the curves of FIG. 2. It will be seen that there is very little difference between them.

The photo current in the circuit of FIG. 1 is passed through the biasing resistor $R_1$ so that the actual bias on the thyratron grid is determined by the sum total of the photo current and the plate and screen currents of tube 1. Since the input sensitivity of the amplifier, for a non-linear input, decreases only slightly with decreasing light intensity this tends to give a flatter sensitivity characteristic than when the bias is independent of light level. The threshold characteristics for the condenser unit of FIG. 1 and for a unit in which the photo current does not pass through the biasing resistor, are shown in FIG. 3. It is apparent that the condenser unit provides a flatter characteristic.

The self destruction time is dependent upon the B drain of the entire unit and consequently there may be variation of self destruction time interval with varying light level. This is minimized by passing the photo current through the biasing resistor. In this way, as the current drain is increased due to greater illumination on the photocell the thyratron grid bias is automatically made more negative.

FIG. 4 shows the circuit layout as actually installed in a fuze. The numbered elements correspond to the similarly numbered elements in FIG. 1. The fuze is assembled from three sections, shown in FIGS. 4, 4A and 4B, comprising the photocell and thyratron section, the A battery and power condensers, and the setback switch and squib, respectively. The plugs and sockets 1*a*, 2*a*, etc. are connected together as well as plugs and sockets 2*b*, etc. The elements to the left of the thyratron 2' in FIG. 4 are the same as in FIG. 1, and are therefore identified by the same reference characters, other elements corresponding to these in FIG. 1 have the same reference characters as in FIG. 1 but with a prime added.

Charging terminal 18, suitably insulated and connected as shown, is provided so that condensers $C_1$ and $C_2$ may be charged by connecting the poles of a battery or other potential source to the casing of the fuze and to terminal 18. Connection with element 18 may be made through a fine wire which can be broken when the projectile is fired, or by use of contacts. This element may be the nose cap of the fuze, suitably insulated, as shown in FIG. 6.

In FIG. 4B normally open switch 26 serves to connect the A battery 3' into the circuit, when it is closed. Normally open switch 27 similarly connects the squib 4' into the circuit when it is closed. Normally closed switch 28 permits power condensers $C_1'$ and $C_2'$ to be charged from charging terminal 18, but must be opened during the flight of the projectile when the fuze is in active operation. All this may be accomplished in well-known manner by making these three switches responsive to set-back when the projectile is launched or discharged, to operate these switches from their normal condition into their operative condition, in which switches 26 and 27 will be closed and switch 28 will be open. Instead of utilizing set-back, it is also obvious that the switches may be manually operated by the same action that sets the projectile into action, the details of either operation being of known construction and no part of the present invention.

Resistance 19, preferably of about 1 megohm, is included in order to prevent accidental discharge of the condensers on set-back, due to the presence of a possible residual lead on the outside of the fuze head, in case a fine wire connection is used.

In the circuit diagram, FIG. 4, the cathode of photoelectric cell 5, which is preferably sensitive in the blue region, is connected to the control grid of electronic tube 1, through grid blocking condenser 10 which can pass an electrical pulsation but not a steady electrical current. The collector electrode or anode of photo-electric cell 5 is connected with plug 7*a* which is connected with the positive side of condenser $C_2'$. One terminal of impedance 8 is connected to cathode of tube 5 and the other terminal is connected to the cathode of tube 1. The metal fuze body, can, and the projectile, together, may constitute the ground. Element 8 is a special form of resistance, known by such trade names as "Varistor" or "Thyrite" and has the property that the resistance of element 8 is reduced as the current passing through it is increased. This tends to make the transient voltage input to the amplifier, for small light changes, proportional to the fractional change in light, more or less independently of the total light level.

Grid leak 11 is connected from grid of tube 1 to the cathode and serves to maintain the grid at a constant potential bias by allowing leakage of accumulated electrons to cathode. This resistance may also be considered as a portion of the input resistance, the terminal potential fluctuations of which are transferred to the grid of tube 1. The screen grid of tube 1 is connected to plug 7*a*, and consequently to condenser $C_2'$, through resistance 7 which is of greater value than resistance 6 which connects plate or anode of tube 1 with condenser $C_2'$. The resistances are such that the screen grid is maintained at about the same potential, relative to the filament, as the plate of tube 1. The parallel-connected filaments of tubes 1 and 2 will be supplied with current from A battery 3', through resistance 15 when plugs 1*a* and 4*a* make contact with their corresponding sockets, after switch 26 is closed by set-back forces.

The thyratron grid is connected with the plate-connected terminal of resistance 6 through condenser 13 which blocks steady potential from condenser $C_2'$ from grid 84 but which will pass potential pulsations due to change of current passing through coupling resistance 6 which is connected to condenser $C_2'$ as described. Condenser 30, connected between the condenser-connected terminal of resistance 6 and the plate of tube 1, acts as a by-pass for the thyratron input, to reduce the response to very high frequencies or extremely sudden changes in the amplifier output, as produced by noise or other causes.

The thyratron grid is connected to plug 2*a* through resistance 14 which is of sufficiently high value to apply a negative grid bias from condenser $C_2'$ and yet not interfere with proper operation of the grid. It will be seen that $C_2'$ will apply a negative bias to this grid with respect to the filament, when plugs 1*a* and 2*a* make contact with their corresponding sockets which are connected, respectively, with the positive and negative terminals of resistor $R_1'$, as previously described.

Capacitance $C_1'$, of relatively large value, is connected across the squib 4 through tube 2' when switch 27 is closed. This capacitance acts as a reservoir of accumulated energy from charging terminal 18 through switch 28 and discharges this energy suddenly through the squib when the thyratron is fired. The squib will also be fired to explode a suitable booster charge by the self-destruction circuit, as previously explained after an interval, provided that the detonator has not previously fired as a result of a variation of output of photoelectric cell 5.

In using the device, the fuze is screwed into a rocket, shell, or other projectile which is subsequently fired at a target such, for instance, as an airplane. When the fuze and lens come near the airplane a certain amount of sky light which would otherwise reach the photoelectric cell cathode through the lens is obscured by the aircraft, and sudden reduction of electron output from the cathode occurs, since the fuze is travelling at a rapid rate.

This sudden diminution of electron emission from the cathode of the photoelectric cell 5 results in a diminished current flow, as previously described, with the result that the potential drop across resistance 8 is suddenly decreased, which causes a negative current pulse through condenser 10 so that the grid of tube 1 is suddenly made more negative and the current flow passing through the plate of tube 1, coupling resistance 6 and condenser $C_2'$ is reduced. Since condenser $C_2'$ is connected in circuit with resistance 6, and since thyratron grid condenser 13 is connected to the plate terminal of resistance 6, a diminution of current through resistance 6 will result in a potential rise of the plate-connected terminal of resistance 6. This produces a positive pulse through condenser 13, thereby making the thyratron grid less negative so that it suddenly becomes conducting and fires the detonator.

FIG. 5 shows a condenser powered circuit similar to that of FIG. 1 but employing only one charged condenser $C_2''$ instead of two. The output of condenser $C_2''$ is passed through voltage divider $R_2$, $R_1''$ and the potential drop across resistance $R_1''$ is used to bias the grid of thyratron 16 as before. It will be noticed that the photocell current does not traverse resistor $R_1''$ and so the bias is independent of light level.

Elements are similarly numbered to corresponding elements in FIGS. 1 and 4, but the numbers are double-primed to distinguish from the preceding Figures.

In order to enable the thyratron to pass a relatively large current to fire the squib, by-pass condenser $C_3$ is connected across resistance $R_1''$. Since the firing pulse is rather sharp the condenser $C_3$ will pass sufficient current.

In FIG. 6 a fuze is shown embodying our invention and corresponding to the elements shown in FIGS. 4 and 4A. Terminals **2*b*, 3*b*, 5*b* and 6*b* correspond to the similarly numbered terminals shown in FIG. 4A. Photocell 5 is located near the nose of the fuze axially just behind charging terminal 18, and is surrounded by an annular lens 20 which focuses light from the desired angle of "look" or photoelectric sensitivity, upon the sensitive portion of photocell 5. This Figure is intended to show schematically a practicable arrangement of the elements shown in the circuit diagrams of FIGS. 1, 4 or 5. Integral threaded shoulder 24 is provided so that the fuze may be screwed into a projectile, threaded shoulder 25**, of lesser diameter, is provided so that the fuze may be fastened to a cylindrical can (not shown), containing the usual squib and booster, and such safety arming devices as it may be desired to incorporate.

As shown in FIG. 6, the power condenser $C_2$ may be toroidal and arranged as indicated. In case two condensers are used, both may be toroidal and coaxial.

This light-sensitive fuze provides a very effective weapon for attacking and destroying enemy aircraft, when used in conjunction with explosive projectiles such as rocket devices, shells, or bombs. In addition, experiments have shown that the fuze is very effective in causing bombs to explode on ground approach, so that the fragments will be scattered downward for greater destructive effect. Such fuzes might also be used in other military applications and various principles described could be adapted to numerous commercial devices such as photoelectrically controlled mechanisms.

It is obvious that many changes of detail can be made without departing from the broad principles of my invention as defined in the appended claims.

We claim:

1. In a proximity fuze comprising a target-responsive circuit including a first electronic grid controlled tube and a squib detonating circuit including a second electronic grid controlled tube; a B tube voltage supply for said tube circuits comprising a condenser, an external connection for charging said condenser from an external source, and circuit means for connecting said condenser to said tube circuits, said circuit means including a biasing resistor connected between the minus terminal of said condenser and the cathode of said first grid controlled tube, a second biasing resistor connected between the grid of the second grid controlled tube and the minus terminal of said condenser whereby when the B drain of the said fuze exceeds a predetermined level, the bias on said second grid controlled tube is reduced to the firing point, thereby igniting said squib.

2. In a proximity fuze comprising a target-responsive circuit including a first electronic tube having control grid, anode and cathode elements and a squib detonating circuit including a second electronic tube having a control grid, anode and cathode elements; a voltage supply circuit for said tube circuits comprising a condenser having its positive terminal connected to one terminal of the squib of said squib detonating circuit, the other terminal of said squib being connected to the anode of said second electronic tube, an external connection on said fuze for charging said condenser from an external source, circuit means for connecting said condenser to said tube circuits to energize said fuze for target-responsive action, including a grid biasing circuit for said second electronic tube arranged to initially bias said tube to open circuit condition when said condenser is fully charged, and to bias said tube to closed circuit condition when said target responsive circuit reacts to the presence of a target said grid biasing circuit comprising a biasing resistor connected between the minus terminal of said condenser and the cathode of said first electronic tube, and a second biasing resistor connected between the grid of the second electronic tube and the minus terminal of said condenser, and means for progressively increasing the sensitivity of the squib detonating circuit.

3. The invention as recited in claim 2 wherein said means comprise said condenser and said biasing resistor connected between the minus terminal of said condenser and the cathode of said first electronic tube, the cathodes of said first and second electronic tubes being connected in parallel, said condenser discharging after initial energization with accompanying progressive diminishing of current flow through said biasing resistor and thereby causing a progressive decrease in negative grid bias on said second electronic tube, whereby said second electronic tube becomes progressively more sensitive to stimulation of the target-responsive circuit due to the presence of a target, and said condenser subsequently discharging to reduce the said bias to the firing value of said second electronic tube after a predetermined period of time to function said squib and cause distruction of the fuse if a target has not been encountered.

* * * * *